United States Patent [19]

Landis

[11] Patent Number: 4,872,586

[45] Date of Patent: Oct. 10, 1989

[54] CONTAINER CLOSURE AND ASSEMBLY

[75] Inventor: H. Richard Landis, Oak Lawn, Ill.

[73] Assignee: Landis Plastics, Inc., Chicago, Ill.

[21] Appl. No.: 101,039

[22] Filed: Sep. 25, 1987

[51] Int. Cl.[4] ..... B65D 39/00

[52] U.S. Cl. ..... 220/307; 220/306; 220/380

[58] Field of Search ..... 220/306, 307, 380

[56] References Cited

U.S. PATENT DOCUMENTS

| | | | |
|---|---|---|---|
| 3,339,786 | 9/1967 | Biglin | 220/380 X |
| 3,743,133 | 7/1973 | Rathbun | 220/306 |
| 3,811,597 | 5/1974 | Frankenberg et al. | 220/306 X |
| 3,880,288 | 4/1975 | Hunter | 220/380 X |
| 4,252,248 | 2/1981 | Obrist et al. | 220/270 |
| 4,296,871 | 10/1981 | Andersson | 220/306 |
| 4,387,828 | 6/1983 | Yates, Jr. | 220/306 X |
| 4,444,332 | 4/1984 | Widen et al. | 220/306 |
| 4,518,097 | 5/1985 | Milton et al. | 220/307 |
| 4,660,735 | 4/1987 | Peschardt et al. | 220/306 X |

*Primary Examiner*—Stephen Marcus

*Assistant Examiner*—Nova Stucker

*Attorney, Agent, or Firm*—Fitch, Even, Tabin & Flannery

[57] ABSTRACT

Disclosed is a plastic injection molded container and closure assembly wherein the closure has a plug-like section and an outer skirt. The plug-like section includes a vertical cylindrical wall having upper and lower annular nesting surfaces for nesting closures in a stack. An annular top wall outwardly extends from the vertical cylindrical wall upper end and a skirt depends downwardly from the outer periphery of the outer top wall. The lower free end of the skirt includes a bead defining a thick cross-sectional area on the skirt for engaging the upper flange of a container when mated therewith. The container upper flange extends outwardly and downwardly from the open end of the container and has a free end engaging the bead on the closure skirt. The container has a sealing lip of increased cross-sectional thickness at the container rim projecting radially inwardly into sealing engagement with the vertical cylindrical wall on the plug-like section.

11 Claims, 1 Drawing Sheet

CONTAINER CLOSURE AND ASSEMBLY

FIELD OF THE INVENTION

The present invention pertains to injection molded containers, closures and assemblies thereof.

DESCRIPTION OF THE PRIOR ART

Food products such as cottage cheese, sour cream dressing or the like dairy products are currently packaged in plastic containers having thermoformed plastic lids or closures therefor. That is, the lids are formed from a thin plastic sheet having a uniform, very thin, cross-sectional thickness throughout the closure which results in a closure that is very light weight and very flexible. These thermoformed lids characteristically have what is commonly termed a "plug fit," i.e., a recessed plug-like central portion for insertion within and to have a tight frictional engagement with the interior slanted surface of the container. The plug central portion has a lower portion of a greater diameter than its upper portion to assure that the lower end of the plug portion grips the container tightly and seals thereto with a plug fit. When the container is fully mated with the lid, the container rim is positioned between the deep central plug-like portion of the lid and an outer encircling skirt on the closure. The container and lid are typically thermoformed from styrene. The thermoformed styrene lids for these containers require a secondary post-forming operation after molding in which the interior locking bead is formed on the deep skirt. This secondary operation requires additional investment and extra handling of the product. These thermoformed lids are used to package products with high speed packaging equipment which not only positions the containers for automatic filling, but also automatically caps the filled container with closures taken from a vertical stack of nested closures.

Injection molded lids may be made with non-uniform, cross-sectional thicknesses and may have increased cross-sectional thicknesses at locking beads or at stacking rings on the closures. Injection molded containers may be made more rigid by having increased wall thickness at areas which would bend.

To provide an injection molded closure to replace these thermoformed closures, the injection molded closure and/or container should be able to be used with existing packaging equipment for thermoformed dairy lids to be a commercially important product.

A need exists for injection molded lids to replace thermoformed lids of this kind and for injection molded lids having an improved nesting facility, and particularly a nesting facility in which lids are predictably oriented with respect to each other when placed in a stack and wherein wedging between adjacent lids is avoided. U.S. Pat. No. 4,037,748 discloses a plug-like lid with a plug portion having a rounded cylindrical corner with a downwardly extending ring, generally triangular in cross-sectional and radially inset from the plug wall. When lids of this type are stacked in a nested configuration, it is likely that the upper lid will pivot in a socket-like engagement with a lid located immediately therebelow, owing to the rounded bottom portion of the plug. Thus, orientation of the several lids and a nested stack of lids is not predictable or well-defined and thus, is not readily suited for use in automated packaging equipment such as robotic arms and the like, which are limited to preprogrammed steps which displace the arm in well-defined incremental movements and three dimensional space. In general, it is required that the lids be maintained in a well-defined reference plane if they are to be used with automated equipment of this type. U.S. Pat. No. 4,103,803 suffers from the same deficiencies, especially since it does not include the downwardly extending wall of triangular cross-section as in the 4,037,748 patent.

The plug-like lid of U.S. Pat. No. 4,682,706 is typical of those lids prone to jamming or wedging when nested in a stacked configuration. The plug-like portion of the lid includes a downwardly tapered frustoconical structure which is easily wedged with corresponding frustoconical portions of lids placed therebelow. Even if adjacent lids in a stack of lids of this type are not pressed together so tightly as to become wedged together, it is likely that the upper lid will be pivoted in a socket like engagement with the lid located immediately therebelow, thus suffering from the problems described above with respect to automated assembly of the lid to a container.

U.S. Pat. Nos. 4,046,282 and 4,252,248 have plug-like lids with beveled inwardly tapered plug portions. However, wedging of adjacent lids when nested in a stack is not likely to occur since these lids also contain radially inwardly extending walls or handle portions at the upper end of the lid which partially overly the bottom wall of the plug portion. Thus, when nested together in a stack, the bottom wall of the plug portion contacts the radially inward wall or handle of a lid located immediately therebelow. Nesting of these types of lids is very inefficient space-wise because of the inwardly extending wall-like handles.

The following U.S. Pat. Nos. 4,079,857; 4,111,329; 4,165,020; 4,418,833; and 4,474,304 either have plug-like lids or lids having portions extending very slightly into the interior of a container (as in U.S. Pat. No. 4,111,329). However, wedging of the plug-like central portions of the lids is not a problem since the lids also contain skirts located at the outer extremity of the lids which are considerably longer than the plug-like central portions. In general, these lids do not have desirable nesting characteristics in that they are positionally unstable when stacked one on top of the other and there is very little, if any, interfitting between adjacent lids of a stack so that space savings are not realized.

It is therefore desirable to provide an injection molded container and lid therefor which have greater rigidity and strength than a thermoformed container and lid having a traditional plug portion and skirt features and can be used with existing filling and capping equipment. A problem with injection molded containers is to mold them with walls and surfaces that will withdraw from the mold without having to have special movable mold sections to allow a tapered surface to be withdrawn from the mold.

SUMMARY OF THE INVENTION

Accordingly, it is an object of the present invention to provide an injection molded container and a lid therefor having a plug portion and an encircling skirt which is inexpensively manufactured with injection molding equipment and without secondary operations, using conventional techniques.

Another object of the present invention is to provide a lid which does not become jammed with other lids when nested or stacked therewith.

These and other objects of the present invention are provided in a one-piece plastic injection molded closure or lid of resilient flexible plastic material which consists of a substantially cylindrical vertical plug wall having upper and lower ends and an outside surface, a disk-like central panel having an outer periphery joined to the lower end of the cylindrical wall; and an annular top wall outwardly extending from the cylindrical plug wall upper end. The lower end of the cylindrical plug wall is joined to the bottom panel and defines an annular nesting surface extending laterally inwardly from the outside surface so as to engage the upper end of a cylindrical plug wall of another lid nested therewith. A skirt depends downwardly from the top wall so as to form a channel-like receptacle with the top wall and the cylindrical plug wall, for receiving an upper free end of a mating container having an open end enclosed by the lid. A lip of increased thickness is formed on the container wall to provide rigidity and to seal with the plug on the lid. A locking bead facility is formed on the lid skirt and on the exterior of the container rim to interlock the lid to the container rim.

BRIEF DESCRIPTION OF THE DRAWINGS

In the drawings, wherein like elements are referenced alike.

DETAILED DESCRIPTION OF THE PREFERRED EMBODIMENT

Figure 1:
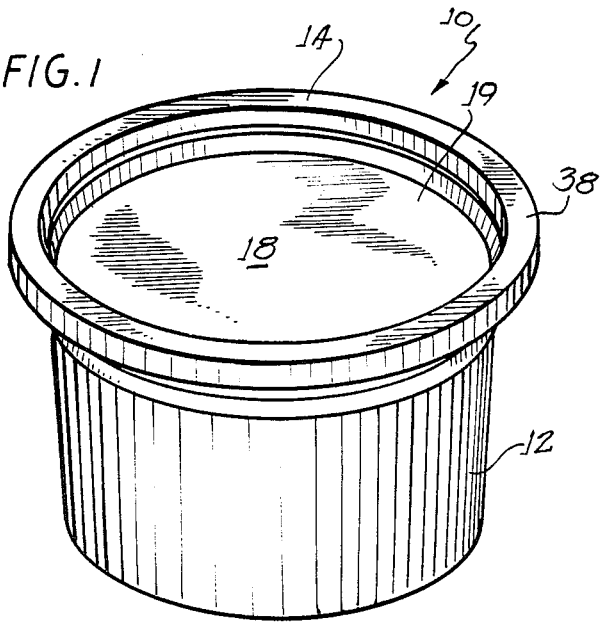
FIG. 1 is a perspective view of a container and closure assembly illustrating aspects of the present invention.
Figure 2:
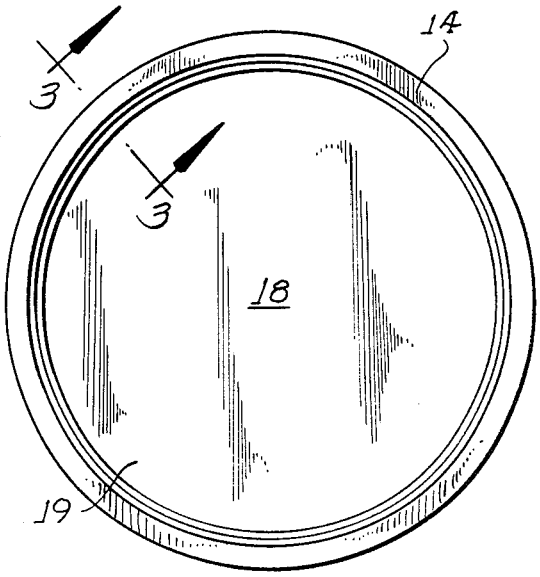
FIG. 2 is a top plan view of the container and closure assembly of FIG. 1.

Referring to the drawings, FIG. 1 illustrates an assembly 10 comprising a container 12 and a closure or lid 14. The container and lid of the preferred embodiment preferably have a configuration resembling that of containers used in the dairy industry for packaging cottage cheese, sour cream dressing or the like. These assemblies have traditionally been manufactured from a thin sheet of styrene using thermoforming and secondary post-forming techniques to form a very thin, flexible lid of uniform cross-sectional thickness. As distinguished therefrom, the container and lid of the preferred embodiment is constructed of polyethylene using injection molding techniques to form a more rigid lid having cross sections of different thicknesses to provide more rigidity and to provide a lid which does not require post-forming or other secondary operations. As a result, the container and lid of the preferred embodiment are substantially stronger than prior art thermoformed styrene container assemblies and have improved strength and resilient locking features.

Figure 4:
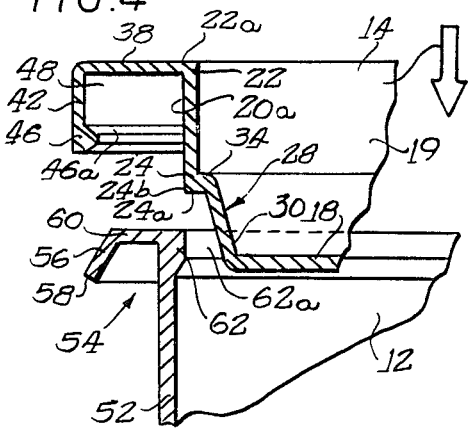
FIG. 4 is an exploded cross-sectional fragmentary view corresponding to that of FIG. 3, but showing the closure separated from the container prior to mating therewith.
Figure 3:
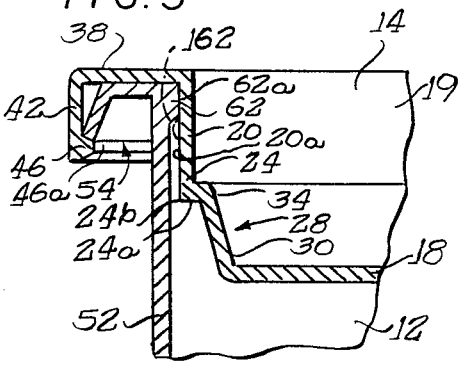
FIG. 3 is a fragmentary cross-sectional view taken along the line 3—3 of FIG. 2 and looking in the direction of the arrows.
Figure 5:
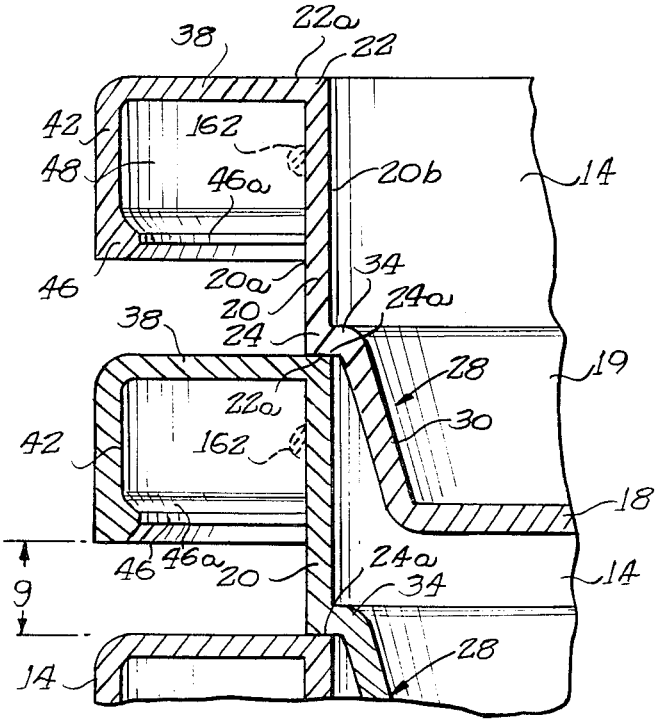
FIG. 5 is a fragmentary cross-sectional view of a plurality of nested closures, stacked one on top of the other.

The lid of the preferred embodiment of the container to which the present invention is directed is characterized by an outer encircling skirt and an inner central portion providing a plug-type fit with its mating container. Referring now to FIGS. 3–5, the lid 14 includes a central disk-like panel bottom or wall 18 having an outer generally circular periphery and forming the bottom of a central plug-like portion 19 which, as will be seen, encloses the major portion of the container opening. Lid 14 further includes a vertical substantially cylindrical side wall 20 having an upper end 22 and a lower end 24. Side wall 20 also has external and internal surfaces **20*a*, 20*b*, respectively (see FIG. 5) which are preferably parallel to each other and which have no draft, that is the surfaces 20*a* and 20*b* are preferably at a true vertical without any inclination, that would interfere with removal of the vertical plug well 20 from the injection molds (not shown). It is contemplated that the interior surface 20*b* may be slanted to assist in release from the mold. Alternatively, the external wall surface could be drafted, i.e. at a slant, to effect mold release. A typical draft would be 1° to 5° for mold release. The wall 20 will still be substantially vertical even though one or more sides 20*a* or 20*b* may have a small draft. The vertical plug walls 20 may be stacked in a strong vertical column as shown in FIG. 5. According to an important feature of the present invention, the lower end 24 of cylindrical plug wall 20 is connected to the outer periphery of bottom wall 18 by an inwardly extending frustoconical portion 28 having a frustoconical wall 30 and a horizontal annular wall or ledge 34 between the vertical wall 20 and the frustoconical wall 30. The latter has a lower end of which is blended into the outer periphery of bottom wall 18. Thus, the upper end of frustoconical wall 30 is preferably connected to side wall 20 through a short generally lateral, perpendicular or radially-directed ledge 34 which is generally parallel to the bottom wall 18. The ledge 34 provides an important feature of the present invention, namely the annular nesting surface 24*a*, (see FIGS. 3 and 4) located at the lower end of side wall 20. As will be seen, nesting surface 24*a* engages an upper nesting surface 22*a* on the upper end 22 of the cylindrical side wall 20** of a lower lid nested or stacked therewith.

The plug wall 20 is preferably a true substantially vertical wall with no draft or inclination to the vertical. If the plug wall 20 were slanted like the tapered wall 34, the lids would jam against one another and the wall 20 would not release easily from the injection mold cavity.

Referring again to the upper end of lid 14, an annular, generally horizontal top wall 38 extends outwardly from the upper end 22 of cylindrical side wall 20. The top wall 38 and upper end 22 of cylindrical side wall 20 together form an upper flat nesting surface on the lid 14, and the advantage of this feature will become apparent when nesting of the lids is considered. A generally vertical skirt 42 depends downwardly from the outer periphery of top wall 38 and has a lower free end which includes an inwardly extending bead 46 which has a cross sectional thickness substantially greater than the wall thickness of the skirt 42. This thicker, encircling bead adds rigidity and strength to the rim portion of the lid. As illustrated, the skirt 42 is preferably cylindrical in configuration and is generally vertically oriented. The cylindrical side wall 20, top wall 38 and skirt 42 form a downwardly opening channel for receiving the upper end or annular rim of container 12 when mated therewith (see FIG. 3).

Referring now to FIGS. 3 and 4, container 12 is preferably an injection molded container which includes an outer encircling wall, the upper end of which is terminated in an annular rim generally indicated at 54 (see FIG. 3). Rim 54 has a downwardly extending outwardly tapered flange 56 with a lower free end 58 and an upper end connected to the upper end of container 12 by a generally horizontal connecting wall 60. As illustrated in FIGS. 3 and 4, the annular rim 54 includes a radially inwardly extending lip portion 62 having an inner surface inwardly displaced from the inner surface of container wall 52 which engages the outer surface 20*a* of cylindrical side wall 20 when container and closure are mated. As shown in FIGS. 3 and 4, the lip portion 62 is of thicker cross-section than the container wall 52 to give added rigidity and strength to the container rim at the area of sealing contact with the lid. As indicated above, container 12 and lid 14 are preferably formed from injection molded polyethylene. The thinner connecting wall 60 is flexibly or resiliently connected to container wall 52, and flange 56 provides a resilient or flexible connecting wall 60. As will be seen, these resilient features play an important role in providing locking engagement with the mating lid 14.

Referring additionally to FIG. 5, the lid 14 offers improved nesting which eliminates jamming or unintentional wedged interconnection between lids when stacked one on top of the other. In order to replace the thermoformed lids which are nested and removed automatically from the stack by the packaging equipment, it is essential that the lid 14 be nested in stacks in a manner to be released and handled by the same packaging equipment. As illustrated in FIG. 5, a stack of internested lids 14 have their cylindrical side walls 20 aligned end to end, with the lower nesting surface 24 on an upper lid engaging the upper nesting surface 22*a* of the side wall 20 of another lid located immediately therebelow. As shown in FIG. 5, the straight, vertical walls 20 are aligned vertically and in a vertical column. Thus, the lids have straight cylindrical walls which cumulatively define a straight vertical cylinder divided into a stack of cylindrical strips, i.e. a composite cylinder thereby providing rigidity to the stack of lids. Not only is wedged inter-engagement between stacked lids eliminated, a precise orientation of lids in a stack of lids is maintained, an important feature for robotic assembly apparatus which relies on the lids being oriented in a predetermined position defined by the programming or software controlling of the robot movement. If, for example, the frustoconical walls 30 were replaced with generally rounded or part-spherical walls, engagement between stacked lids may be prevented but the orientation of one lid relative to another or relative to a reference surface would not be predictable. Also, a free standing stack of the round bottom lids would be limited in height due to the uncontrolled attitude of one lid relative to another in the stack. When a rounded wall of an upper closure is placed on top of a lower closure, the upper closure may pivot within the lower closure, somewhat resembling a "ball and socket" configuration. Thus, even if the lower closure is fixed in position, the upper closure would not be constrained, but rather would be free to tilt, rock, or pivot, with its upper surface assuming an inclined position relative to a vertical direction, for example.

Referring again to FIGS. 3–5, another distinguishing feature of the lid of the present invention is that the "plug-type" fit with its mating container (see especially FIG. 3) is up near the top rim of the container at the reinforced thicker lip 62 which projects radially inwardly of the tapered side wall 52. While the cylindrical wall 20, frustoconical wall 30 and bottom wall 18 form a plug-like member received in and enclosing the upper end of the mating container, the tight sealing engagement is at the upper end of the plug where there is tight frictional engagement between the vertical, exterior plug surface 20*a* and a vertical interior surface 62*a* on the lid container lip 62.

FIG. 3 shows the lid and container in a fully mated and sealed condition with the upper free end or rim 54 of container 12 received in the downwardly opening channel 48 formed at the outer periphery of lid 14. As lid 14 is lowered into engagement with the upper end of container 12, contact is made between frustoconical wall 30 and the inwardly extending lip portion 62 providing a "self-centering" alignment between the two members. Engagement between the annular nesting surface 24*a* of the lid and the upper corner of lip 62 has not been found to impede the fully mated condition as illustrated in FIG. 3. If desired, however, the inside upper corner of lip 62 can be downwardly and inwardly beveled to provide a camming surface for nesting surface 24*a*, and more particularly, for the outside corner 24*b* formed at the intersection of annular nesting surface 24*a* and the outside surface 20*a* of cylindrical side wall 20.

As the plug-like central portion 19 of lid 14 is lowered onto the open end of container 12, bead 46 contacts inclined flange 56 causing an inward deflection of the free end 58 thereof and simultaneously there will be some outward flexing of the skirt 42 of the closure. Preferably, flange 56 deflects at its point of connection with wall 60 as bead 46 is cammed against the flange, thereby allowing passage of the lower end of skirt 42 over rim 54. When fully seated, connecting wall 60 of container 12 is brought in to contact with the top wall 38 of lid 14 as free end 58 of flange 56 passes over the radial inmost extent of bead 46. Preferably, the upper surface of bead 46 is upwardly beveled with a camming surface 46*a* dimensioned for engagement with substantial portions and preferably the entirety of the free end 58 of flange 56. As illustrated in FIG. 3, free end 58 is completely engaged with the upper surface 46*a* of bead 46 so as to be effectively wedged between bead surface 46*a* and top wall 38, thereby providing a secure locking engagement with the closure channel 48.

By way of example only and not limitation, a preferred closure and container assembly constructed according to the principles of the present invention will now be described. The closure and container were preferably injection molded of 0.020 inch thick L.L.D.P.E. polyethylene material except for the areas of increased cross-sectional thickness such as at the container lip 62 and the lid skirt bead 46. The vertical distance from the top wall 38 to bottom wall 18 was 0.360 while the vertical height of skirt 42 (as measured from top wall 38 to the bottom free end thereof) was 0.156 inch. Referring to FIG. 5, considerable space savings is provided with the improved nesting according to the present invention wherein a gap g of only 0.078 inch is present between the bottom free end of the skirt 42 of an upper lid 14 and the top wall 38 of another lid nested immediately therebelow (see FIG. 5). It can thus be seen that the nesting surface 24*a* of the preferred embodiment is spaced 0.078 inch below the free end of skirt 42. Thus, the skirt of the preferred embodiment has a length approximately equal to 8 times the material thickness whereas the cylindrical side wall 20 has a length approximately 12 times the material thickness. Typical dairy containers are 8, 12, 16, 24 and 32 oz. containers having an outer diameter of about 4.230 inch and respective heights of about 1.75, 2.43, 3.16, 4.66 and 5.73 inches. Manifestly, other shapes and sizes may be used and fall within the terms of this invention.

The preferred injection molded plastic is polyethlyene which has a moisture resistance of several times that of the thermoformed styrene and hence makes for a better protective material for many dairy products than does styrene. Also, the thermoformed walls are typically only about 0.010 or 0.011 inch thick and the preferred wall thickness herein is double that thickness to give better shelf life characteristics. In drop tests of four or five feet, the dairy products pushed up on the center panel 18 of the lid and caused a better gripping of the lid as the vertical wall 20 was pushed radially outwardly beneath the lip portion 62. The lids held under such a drop test. If desired, an annular bead 162 shown in phantom lines in FIGS. 3 and 5 could be formed in the exterior side wall surface 20*a* to project radially outwardly beneath the lip portion 62 to engage the lip portion and provide additional holding force to retain the lid against removal.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. An injection molded plastic closure having nonuniform wall thickness for application to a container having a container sidewall and a container rim, said closure comprising:

a top central circular panel for covering an open container, a plug-like portion extending upwardly from the central circular panel and for insertion into the open mouth of the container for sealing engagement with the container side wall, an encircling rim on the closure extending radially outwardly from the plug-like portion and having an outer depending skirt, an enlarged bead of a cross-sectional thickness substantially greater than the cross-sectional thickness of said skirt and said top central panel for locking engagement with the container rim, said plug-like portion having a substantially vertical upper wall portion and a lower wall portion offset radially inwardly from the vertical upper wall portion, a lateral offset portion interconnecting the upper vertical wall portion and the offset lower wall portion, a lower nesting surface on the bottom side of the lateral offset portion, and an upper nesting surface on the top of the vertical upper wall portion for engagement, said lower nesting surface engaging the upper nesting surface of another closure stacked therebelow and the upper surface on said closure engaging a lower nesting surface of a closure thereabove to stack the vertical upper wall portions in a vertical column.

2. An injection molded plastic closure having nonuniform wall thickness for application to a container rim, said closure comprising:

a top central circular panel for covering an open container, a plug-like portion extending upwardly from the central circular panel and for insertion into the open mouth of the container for sealing engagement with the container side wall, an encircling rim on the closure extending radially outwardly from the plug-like portion and having an outer depending skirt, an enlarged bead of a cross-sectional thickness substantially greater than the cross-sectional thickness of said skirt and said top central panel for locking engagement with the container rim, a cylindrical section in said plug-like portion having a vertical wall, said vertical wall having a lower horizontal, nesting surface and an upper horizontal nesting surface, the upper nesting surface adapted to engage the lower nesting surface of a closure stacked thereabove to hold said closures with their respective vertical walls vertically aligned to define a composite cylinder a lateral offset portion inwardly extending from said lower horizontal nesting surface so as to form an outside corner therewith and an inwardly tapered frustoconical portion downwardly extending from said offset portion joining said offset to said central circular panel.

3. A plastic molded container and a plastic molded closure assembly comprising:

a container having an upwardly tapered sidewall and a rim portion at the top of the sidewall encircling an open mouth for the container, a rim wall on said rim portion projecting radially outwardly from the tapered sidewall, a depending locking flange on the radially outer edge of the rim wall for locking engagement with said closure, a closure having a plug-like portion and a central circular panel for insertion into the open mouth of the container below the container rim wall, an outer skirt connected to said plug portion and defining therewith an inverted channel to receive the rim portion of the container, a bead on said skirt defining an area of increased cross-sectional thickness on the skirt wall for locking engagement with said depending locking flange on said container, said plug-like portion extending deeply into the container to position the central circular panel substantially below the depending locking flange, said plug-like portion having a vertical wall portion and having a horizontally offset nesting surface located substantially at the middle of the vertical wall portion and located beneath the locking flange, said central panel being located below said offset nesting surface.

4. An assembly in accordance with claim 3 in which the rim portion of said container has a sealing lip having a cross-sectional thickness substantially greater than the thickness of said container sidewall.

5. An assembly in accordance with claim 4 in which a substantially vertical surface on said sealing lip has sealing engagement with a vertical surface on said vertical stacking wall.

6. A one-piece plastic molded closure of resilient flexible plastic material comprising:

a substantially cylindrical wall having upper and lower ends and an outside surface, said lower end defining an annular nesting surface extending laterally inwardly from said outside surface so as to engage the upper end of a cylindrical wall of another closure nested therewith;

a top wall joined to the upper end of said cylindrical wall;

a disk-like bottom panel having an outer periphery joined to said cylindrical wall lower end; and a skirt downwardly depending from the top wall so as to form a channel-like receptacle with said top wall and said cylindrical wall for receiving an upper free end of a mating container having an open end enclosed by said closure, a lateral offset portion inwardly extending from said cylindrical wall lower end so as to form an outside corner therewith and an inwardly tapered frustoconical portion downwardly extending from said offset portion joining said offset portion to said bottom panel.

7. The closure of claim 6 further including a bead upwardly extending from a lower end of said skirt for locking engagement with a free end of a mating container having an open end enclosed by said closure.

8. A plastic molded container and closure assembly comprising:

(a) a container having an encircling container wall, an annular rim on an upper end of said container wall; and (b) a closure including (i) a disk-like bottom panel having an outer periphery;

(ii) a substantially cylindrical wall having an upper end and a lower end joined to the bottom panel at the periphery thereof by an inwardly offset extending portion, a shoulder on said cylindrical wall extending laterally inwardly for engaging the upper end of a cylindrical wall of another closure nested therewith; said shoulder being located at a middle section on the cylindrical wall, (iii) an annular top wall outwardly extending from said cylindrical wall upper end; and (iv) a skirt downwardly depending from the top wall so as to form a channel-like receptacle with said top wall and said cylindrical wall for receiving said container rim.

(v) said shoulder being located beneath said annular rim on said container.

9. The assembly of claim 8 further including a bead inwardly extending from a lower end of said skirt for locking engagement with said container rim.

10. The assembly of claim 9 wherein said container rim includes a downwardly extending outwardly-tapered lip having a free end received in said receptacle so as to lockingly engage said bead.

11. The container of claim 10 wherein said lip is resiliently hinged to said container rim and an upper portion of said bead is rounded for camming engagement therewith.

* * * * *